United States Patent [19]

Takahashi et al.

[11] 4,258,690

[45] Mar. 31, 1981

[54] MACHINING APPARATUS UTILIZING OSCILLATION OF TUNING FORK

[75] Inventors: Akira Takahashi, Tokyo, Japan; Yoshiro Ono, No. 3-7-1101; 3-chome, Kitaaoyama, Minanto-ku, Tokyo, Japan

[73] Assignee: Yoshiro Ono, Tokyo, Japan

[21] Appl. No.: 72,933

[22] Filed: Sep. 6, 1979

[51] Int. Cl.[3] ..... B28D 5/00

[52] U.S. Cl. ..... 125/30 WD; 51/59 SS

[58] Field of Search ..... 125/30 R, 30 WD; 51/59 R, 59 SS

[56] References Cited

U.S. PATENT DOCUMENTS

| | | | |
|---|---|---|---|
| 1,759,112 | 5/1930 | Haddow | 125/30 WD |
| 2,412,101 | 12/1946 | Smyers | 125/30 WD |
| 3,376,786 | 4/1968 | Hetzel | 51/59 R |

*Primary Examiner*—Harold D. Whitehead

*Attorney, Agent, or Firm*—Kerkam, Stowell, Kondracki & Clarke

[57] ABSTRACT

A machining apparatus comprises a mounting base, a tuning fork secured to the mounting base at the root thereof, a driver associated with the forward end of one of the oscillating legs of the tuning fork for driving the tuning fork so as to cause resonant oscillation of the tuning fork, and a machining member fixed to the forward end of the other oscillating leg of the tuning fork for acting on a workpiece.

4 Claims, 3 Drawing Figures

MACHINING APPARATUS UTILIZING OSCILLATION OF TUNING FORK

BACKGROUND OF THE INVENTION

1. Field of the Invention

This invention relates to a machining apparatus, and more particularly to a machining apparatus suitable to polish and cut hard materials.

2. Description of the Prior Art

Recent tools for performing cutting, rolling, or drawing have been made of the hardest materials such as super hard alloys, diamond and compact diamond and contributed to precision machining and high efficient machining. However, it is very difficult to make a tool, for example a wire drawing die of such a hard material. Heretofore, there were used various polishing apparatus, but these apparatus have the disadvantages that it is generally difficult to achieve accurate machining and that the machining operation takes a very long time and requires a skilled worker. In this field, there is a demand for such a machining apparatus with which an unskilled worker can carry out accurate machining in a mass-production line.

Therefore, an object of this invention is to provide a machining apparatus which can easily and efficiently achieve accurate machining and is suitable particularly to machine a hard material.

Another object of this invention is to provide a machining apparatus which is suitable to machine, particularly polish a wire drawing die.

SUMMARY OF THE INVENTION

According to the principle of this invention, machining is made by utilizing resonant oscillation of a tuning fork.

According to a feature of this invention, there is provided a machining apparatus which comprises a mounting base, a tuning fork secured to the mounting base at the root thereof, a driver associated with the forward end of one of the oscillating legs of the tuning fork for driving the tuning fork so as to cause resonant oscillation of the tuning fork, and a machining member fixed to the forward end of the other oscillating leg of the tuning fork for acting on a workpiece.

According to another feature of this invention, there is provided a machining apparatus which comprises a mounting base, a pair of tuning forks secured to the mounting base at the roots thereof and having same natural frequency, at least one driver associated with the forward end of one of the oscillating legs of one of the tuning forks for driving the tuning forks so as to cause resonant oscillation of the tuning forks, and a machining tension string provided in a tense condition between the forward ends of the other oscillating legs of the tuning forks.

DESCRIPTION OF THE PREFERRED EMBODIMENTS

Figure 1:
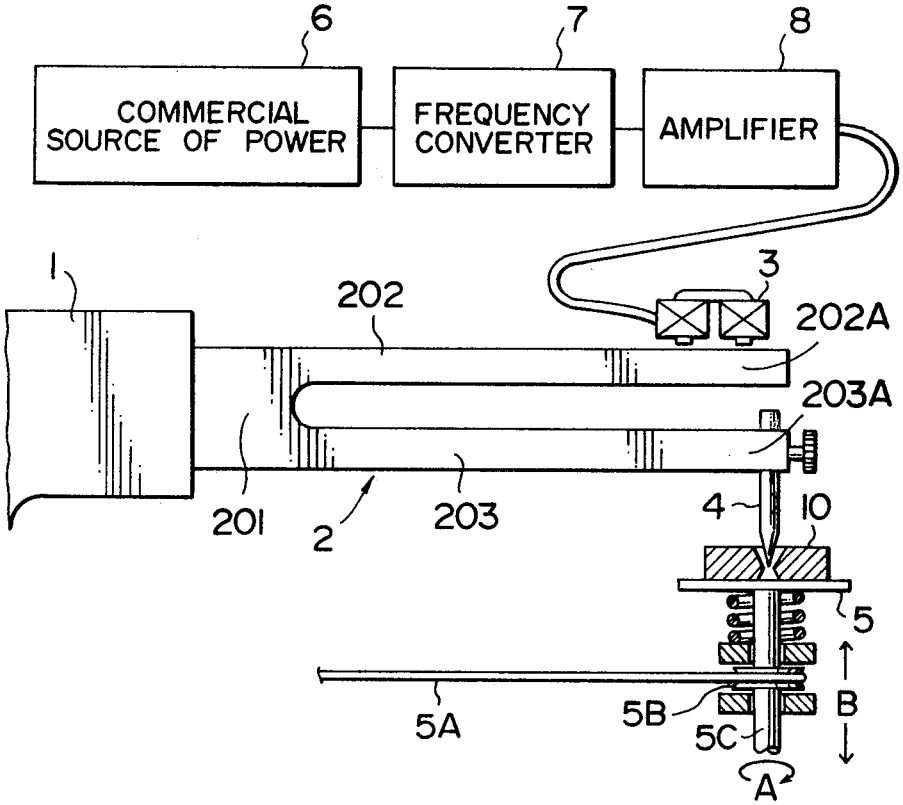
FIG. 1 is a schematic diagram showing an embodiment of machining apparatus according to this invention.

Referring now to FIG. 1, there is shown an embodiment of machining apparatus of this invention in use.

The machining apparatus of FIG. 1 primarily comprises a mounting base 1, a tuning fork 2 secured to the mounting base 1 at the root 201 thereof, a driver 3 associated with the forward end 202A of one 202 of the oscillating legs of the tuning fork 2 for driving the tuning fork 2, a machining needle 4 fixed to the forward end 203A of the other oscillating leg 203 of the tuning fork 2, and a turn table 5 for supporting a workpiece such as a wire drawing die 10. The driver 3 may be secured to the mounting base 1 by means of a suitable supporting member (not shown) and may be for example an electromagnet device. The driver 3 is energized with an electric current having a frequency of for example 1000 Hz equal to the natural frequency of the tuning fork 2 by a commercial source of power 6 through a frequency converter 7 and an amplifier 8 and serves to cause the tuning fork 2 to resonantly oscillate at its natural frequency. This oscillation of the tuning fork 2 is imparted to the machining needle 4, whereby the machining needle 4 is oscillated to polish the wire drawing die 10 on the table 5. The turn table 5 can be rotated in a direction of arrow A by a motor (not shown) through a belt 5A, a pulley 5B and a rotating shaft 5C and can be upwardly and downwardly moved in a direction of arrow B.

The following functional advantages can be obtained from the mounting of the tuning fork 2 to the mounting base 1 at the root 201 thereof as described above. Since a portion of the tuning fork in the vicinity of the root thereof corresponds to the node of oscillation of the tuning fork and thus does not appreciably oscillate, only a small force is required for fixing the root of the tuning fork to the mounting base and almost no energy dissipation from the fixing portion between the root of the tuning fork and the mounting base occurs. Therefore, according to the structure of this invention, it is possible to utilize a higher frequency oscillation for machining and it is also possible to lower damping of oscillation. As a result, it is possible to efficiently use the energy applied to the tuning fork as a machining force.

Figure 2:
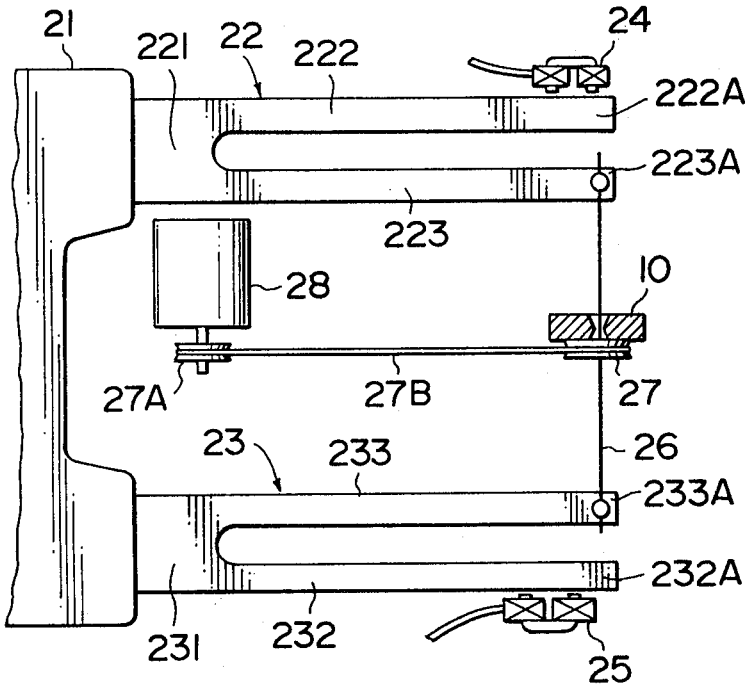
FIG. 2 is a schematic diagram showing another embodiment of machining apparatus according to this invention.

In FIG. 2, there is shown another embodiment of machining apparatus of this invention in use.

The machining apparatus of FIG. 2 primarily comprises a mounting base 21, a pair of tuning forks 22 and 23 secured to the mounting base 21 at the roots 221 and 231 thereof and having same natural frequency, a pair of drivers 24 and 25 associated with the forward ends 222A and 232A of ones of the oscillating legs 222 and 232 of the tuning forks 22 and 23 for driving the respective tuning forks 22 and 23, a machining tension string 26 provided between the forward ends 223A and 233A of the other oscillating legs 223 and 233 of the tuning forks 22 and 23, and a turn table 27 for supporting a workpiece such as a wire drawing die 10. As in the embodiment of FIG. 1, the drivers 24 and 25 may be secured to the mounting base 21 by means of a suitable supporting member (not shown) and may be electromagnet devices which are energized by a source of power having a frequency equal to the natural frequency of the tuning forks 22 and 23 to cause resonant oscillation of the tuning forks 22 and 23. The machining tension string 26 may be made of a metal material or a fibrous material. The string 26 passes through the wire drawing die 10 to be polished and the turn table 27 and is fixed in a suitable tense condition between the oscillating legs 223 and 233 of the tuning forks 22 and 23. The turn table 27 has an opening in its center to permit the machining tension string 26 to pass through the table 27 and can be rotated by a motor 28 through a pulley 27A and a belt 27B.

In the condition of FIG. 2, an abrasive such as a paste containing diamond powder is applied to the machining tension string 26 and the source of power is switched on to energize the drivers 24 and 25. Then, the tuning forks 22 and 23 are resonantly oscillated to cause the tensioned string 26 to vertically (longitudinally) move and vibrate at a high speed and with a very small amplitude, thereby polishing the wire drawing die 10.

Conventional machining systems of the type wherein an abrasive is applied to the slide contacting area between a tension string and a workpiece have the disadvantages that the shape of the polished portion becomes a distorted circle because of its low sliding speed and its mechanism of converting a rotary motion into the reciprocating motion of the string and particularly that problems in the motion of both ends of the string and in the tension maintaining means are caused when operated at a high speed, thereby resulting in bending and distortion of the string. On the contrary, according to the structure of FIG. 2 utilizing the oscillation of tuning forks in accordance with this invention, the motions of both ends of the string are completely tuned, thereby resulting in a completely parallel reciprocation of the string free of deflection, and the string can oscillate at a high speed and with a very small amplitude. Therefore, it is possible to carry out polishing and cutting at a high speed, at a high efficiency and with a high accuracy.

Figure 3:
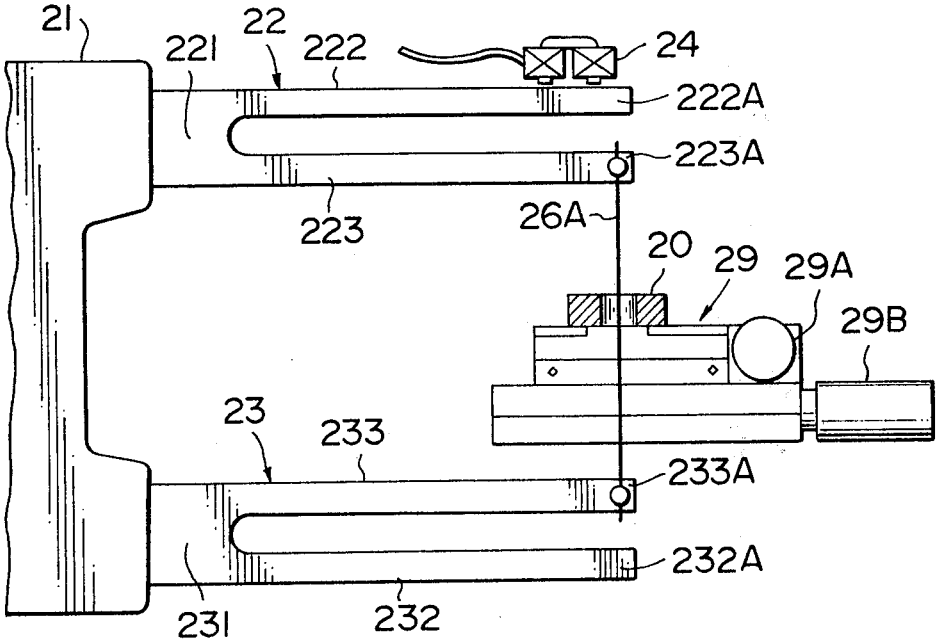
FIG. 3 is a schematic diagram showing a further embodiment of machining apparatus according to this invention.

In FIG. 3, there is shown a further embodiment of machining apparatus of this invention in use.

The machining apparatus of FIG. 3 is suitable for machining a special form die. The general structure of the machining apparatus is similar to that of FIG. 2 and therefore like components are indicated by like reference numerals. In the machining apparatus of FIG. 3, no driver is provided for a tuning fork 23. Only a driver 24 is used to cause resonant oscillation of tuning forks 22 and 23. A piano wire having diamond electrodeposited thereon is used as a machining tension string 26A. Furthermore, an X-Y table 29 in place of a turn table is used for supporting a special form die 20 which is a workpiece. The X-Y table 29 can be moved in an X direction and in a Y direction by means of two pulse motors 29A and 29B. Since the operation of the machining apparatus is similar to that of FIG. 2, it will not be described again.

In the machining apparatus of this invention described above, there is preferably provided a mechanism for gradually changing the relative position of a workpiece to a tension string during machining, thereby preventing the contacting point between them from being concentrated on only one point, in order to distribute the contacting point between the string and the workpiece along a portion of the length of the string and thereby avoid any overheating of the one point of the string. For this purpose, although a tension string may be gradually displaced with respect to a workpiece during machining, it is more convenient to gradually move a workpiece, namely a machining table supporting the workpiece with respect to a tension string.

We claim:

1. A machining apparatus comprising a mounting base, a pair of tuning forks secured to said mounting base at roots thereof and having a same natural frequency, oscillating legs for said tuning forks extending generally in parallel to each other and being opposed to each other in a direction of oscillation of said tuning forks, a machining tension string in a tense condition between forward ends of ones of said oscillating legs of said tuning forks, and at least one driver associated with a forward end of another oscillating leg of one of said tuning forks for driving said tuning forks in resonant oscillation, whereby the motions of both ends of said string are completely tuned resulting in a completely parallel reciprocation of said string free of deflection.

2. A machining apparatus as defined in claim 1, further comprising a table for supporting a workpiece such as a wire drawing die, said table permitting said tension string to pass therethrough.

3. A machining apparatus as defined in claim 2 wherein said machining tension string comprises an abrasive wire to polish a wire drawing die.

4. A machining apparatus as defined in claim 3 wherein said driver comprises an electromagnet device which is energized with an electric current having a frequency of about 1,000 Hz.

* * * * *